US008016109B2

(12) United States Patent
Liang

(10) Patent No.: US 8,016,109 B2
(45) Date of Patent: Sep. 13, 2011

(54) PACKAGE BOX, CUSHION AND PLATE MATERIAL

(75) Inventor: Yu-Chieh Liang, Taipei County (TW)

(73) Assignee: Quanta Computer Inc., Tao Yuan Shien (TW)

( * ) Notice: Subject to any disclaimer, the term of this patent is extended or adjusted under 35 U.S.C. 154(b) by 1078 days.

(21) Appl. No.: 11/878,988

(22) Filed: Jul. 30, 2007

(65) Prior Publication Data

US 2008/0149520 A1 Jun. 26, 2008

(30) Foreign Application Priority Data

Dec. 25, 2006 (TW) ..... 95148850 A

(51) Int. Cl.
*B65D 85/00* (2006.01)
*B65D 85/30* (2006.01)

(52) U.S. Cl. ..... 206/521; 206/588; 206/485

(58) Field of Classification Search ..... 206/521, 206/586, 320, 588, 592, 587, 521.2–521.9, 206/485

See application file for complete search history.

(56) References Cited

U.S. PATENT DOCUMENTS

| | | | | |
|---|---|---|---|---|
| 5,398,808 | A * | 3/1995 | Chen et al. | 206/320 |
| 5,772,025 | A * | 6/1998 | Chen et al. | 206/320 |
| 5,782,354 | A * | 7/1998 | Genix | 206/320 |
| 6,257,412 | B1 * | 7/2001 | Yamamoto et al. | 206/586 |
| 6,942,099 | B1 * | 9/2005 | Wang | 206/521 |
| 2005/0211600 | A1 * | 9/2005 | Saito | 206/586 |
| 2006/0021902 | A1 * | 2/2006 | Chen | 206/586 |

FOREIGN PATENT DOCUMENTS

| | | |
|---|---|---|
| JP | 8-80937 | 3/1996 |
| JP | 10-147376 | 6/1998 |

* cited by examiner

*Primary Examiner* — J. Gregory Pickett
*Assistant Examiner* — Ernesto Grano
(74) *Attorney, Agent, or Firm* — Rabin & Berdo, PC

(57) ABSTRACT

A package box including an outer box and at least two cushions disposed symmetrically in the outer box is provided. The cushion includes a rectangular bottom plate, two short side plates, a partition plate, a concave structure and a box structure. The short side plates are connected perpendicularly with the short sides of the bottom plate respectively. The partition plate divides the cushion into a first rectangular sub-body and a second rectangular sub-body. The concave structure forms a container space caved in the first rectangular sub-body to contain a first article therein. The box structure on the second rectangular sub-body can be opened or closed to contain a second article in the second rectangular sub-body.

17 Claims, 7 Drawing Sheets

PACKAGE BOX, CUSHION AND PLATE MATERIAL

RELATED APPLICATIONS

This application claims priority to Taiwan Application Serial Number 95148850, filed Dec. 25, 2006, which is herein incorporated by reference.

BACKGROUND OF THE INVENTION

1. Field of Invention

The invention relates to a package box, a cushion, and a plate material. More particularly, the invention relates to a package box, a cushion, and a plate material with the container function.

2. Related Art

Electronic devices such as the laptop computer are vulnerable to damages due to external forces during the transportation. Therefore, they have higher demands for the packaging structure. Currently, the most common method is to provide inside the package box several cushions, such as separator boards, paper, plastic cushions, plastic foam, and bubble wraps. They serve the purpose of preventing the electronic devices from hitting the package box walls during the transportation, thereby protecting them from external forces. However, these cushions often have unsmooth edges that may cut the user. Moreover, the plastic cushions have bad impacts to the ecological system. In contrast, paper cushions have fewer impacts to the environment, reduce the stocking space, and enjoy the cost-effective advantage.

To prevent an electronic device from colliding with its accessories (e.g., adapter and batteries) during the transportation process, it is customary to put the accessories inside an accessory box. The electronic device and the accessory box are then inserted into the package box. In this case, a package box has to include a cushion and an accessory box separately. This of course increases the types and number of packaging elements, and inevitably increases the cost for production, transportation, and logistics of the package boxes.

Therefore, it is highly desirable to provide a cushion folded from paper material to also have the container structure, reducing the number and types of packaging elements inside a package box.

SUMMARY OF THE INVENTION

An objective of the invention is to provide a package box and a cushion, wherein the cushion can support and fix the article inside the package box to prevent it from damages due to external impacts.

Another objective of the invention is to provide a cushion folded from paper material in order to be environmentally friendly.

A further objective of the invention is to provide a cushion and a plate material, both of which have smooth and flat shapes to avoid cutting the user.

Yet another objective of the invention is to provide a cushion that can accommodate accessories in order to reduce the number and types of packaging elements inside the package box.

By minimizing the packaging material, the quantity of the disclosed package boxes that can be held in one transportation can be increased. Therefore, the transportation cost can be greatly reduced.

In accord with the above-mentioned objectives, a cushion comprising a bottom plate, two short side plates, a partition plate, a concave structure, and a box structure is disclosed. The bottom plate is shaped of rectangular, having a first long side, a second long side and two short sides. The short side plates are connected perpendicularly with the short sides of the bottom plate. The bottom plate and the short side plates form a rectangular body. The partition plate is disposed between the short side plates, perpendicular to the bottom plate and the short side plates, partitioning the cushion into a first rectangular sub-body and a second rectangular sub-body. The concave structure forms a container space caved in the first rectangular sub-body to contain a first article therein. The box structure on the second rectangular sub-body can be opened or closed to contain a second article in the second rectangular sub-body.

In accord with the above-mentioned objectives, a plate material is disposed to form a cushion of a package box. The plate material includes a bottom plate, two short side plates, a concave structure, a box structure, and a partition plate. The bottom plate is shaped of rectangular, having a first long side, a second long side, and two short sides. The short side plates correspond respectively to the short sides and are connected with the bottom plate. The concave structures includes a first concave plate, a second concave plate, a third concave plate, a fourth concave plate, a fifth concave plate and a top plate connected in sequence. The first concave plate and the bottom plate are connected with the first long side. The box structure includes a first box plate, a second box plate, and a third box plate connected in sequence. The first box plate and the bottom plate are connected with the second long side. The partition plate is connected with the top plate.

In accord with the above-mentioned objectives, a package box comprising an outer box and at least two cushions is disclosed. The cushions are disposed symmetrically inside the outer box. At least one of the cushions has a bottom plate, two short side plates, a partition plate, a concave structure, and a box structure. The bottom plate is shaped of rectangular, having a first long side, a second long side, and two short sides. The short side plates correspond respectively to the short sides and are connected perpendicularly with the bottom plate. The bottom plate and the short side plates form a rectangular body. The partition plate is disposed between the short side plates, perpendicularly with the bottom plate and the short side plates. The partition plate separates the cushion into a first rectangular sub-body and a second rectangular sub-body. The concave structure forms a container space caved in the first rectangular sub-body to contain a first article therein. The box structure on the second rectangular sub-body can be opened or closed to contain a second article in the second rectangular sub-body.

According to an embodiment of the disclosed package box, the cushion can support and fix the articles inside the package box, preventing them from damages due to external impacts.

According to another embodiment of the invention, the material of the cushion is paper that is environmentally friendly.

According to yet another embodiment of the invention, the cushion has a smooth shape to prevent its user from being cut. According to yet another embodiment of the invention, the cushion has the function of accommodating accessories. This can reduce the types and number of packaging elements inside the package box. By minimizing the packaging material stacking, the quantity of the package boxes that can be held in one transportation can be increased. Therefore, the transportation cost is greatly reduced.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

The cushions in conventional package boxes are usually made of plastic, which is not environmentally friendly. Moreover, they often have uneven edges that may cut the user. Besides, the accessory box and the cushion in a package box are separated, inevitably increasing the costs in production, assembly, transportation, and logistics. This invention discloses a cushion folded from paper material and having a smooth shape, thereby preventing the user from being cut. The cushion also has the function of holding accessories, thus the number and types of packaging elements inside the package box can be reduced. Therefore, in addition to minimizing packaging material, the quantity that can be held in one transportation is increased and reduce the transportation cost.

Figure 1:
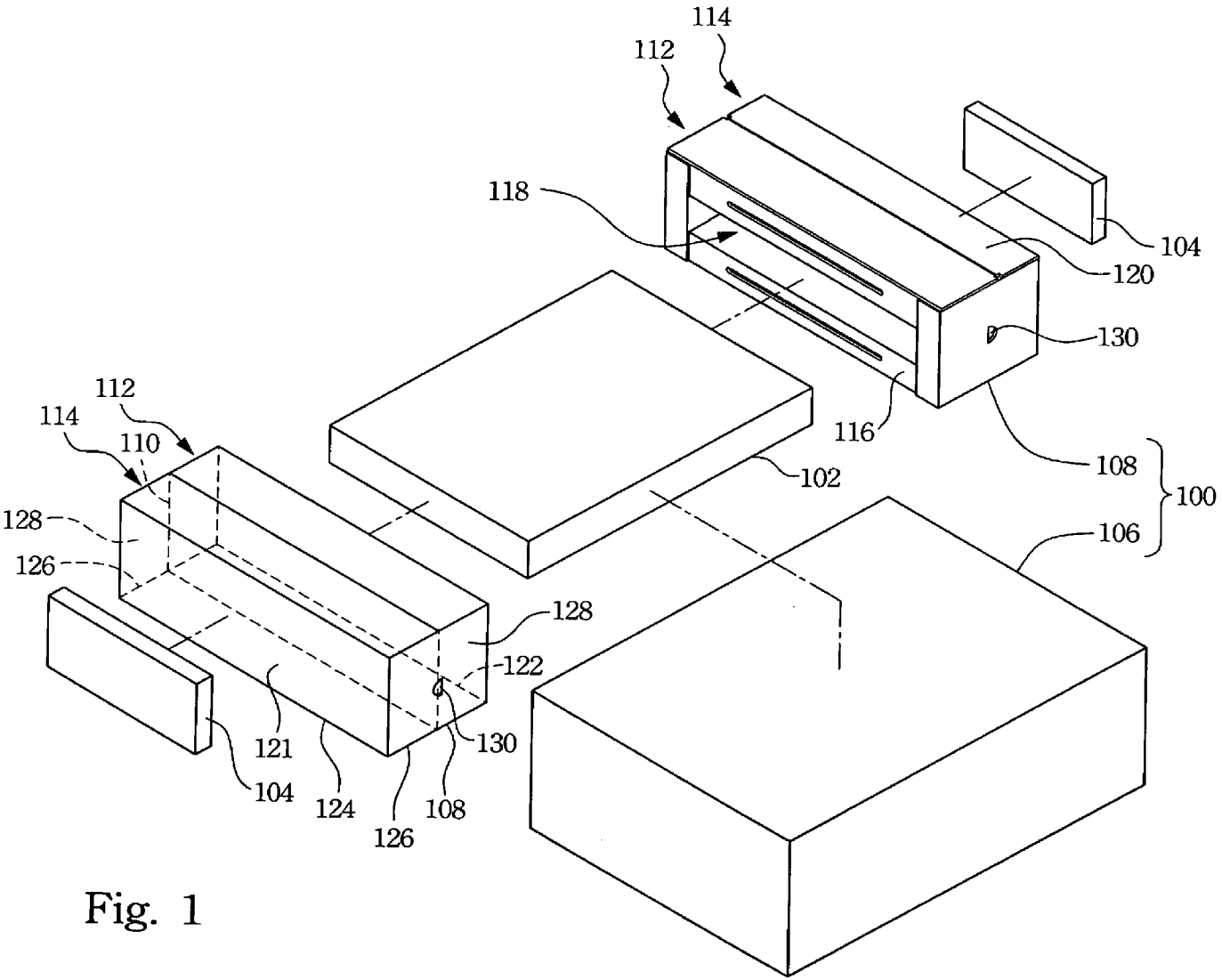
FIG. 1 is a schematic view of the package box in the preferred embodiment of the invention.

As shown in FIG. 1, the package box 100 can accommodate a first article 102 (e.g., a laptop computer) and a second article 104 (e.g., accessories of the laptop computer). The package box 100 includes an outer box 106 and two cushions 108 disposed symmetrically inside the outer box 106. The cushion 108 is shaped of rectangular and has a partition plate 110. The partition plate 110 divides the cushion 108 into a first rectangular sub-body 112 and a second rectangular sub-body 114. The cushion 108 has a concave structure 116. The concave structure 116 forms a container space 118 caved in the first rectangular sub-body 112 to contain a first article 102 therein. The box structure 120 on the second rectangular sub-body 114 can be opened or closed to contain a second article 104 in the second rectangular sub-body 114.

More explicitly, the bottom plate 121 of the cushion 108 is rectangular, having a first long side 122, a second long side 124, and two short sides 126. The short side plates 128 correspond respectively to the short sides 126 and are connected perpendicularly with the bottom plate 121. The bottom plate 121 and the short side plates 128 form a rectangular cushion 108. The partition plate 110 is disposed between the short side plates 128, perpendicular to the bottom plate 121 and the short side plates 128. The first article 102 is disposed inside the container space 118 of the first rectangular sub-body 112. The second article 104 is disposed inside the second rectangular sub-body 114. Therefore, the package box 100 involves only one type of cushion 108, separating the first article 102 and the second article 104 inside the outer box 106. This prevents the first article 102 and the second article 104 from colliding with each other during transportation. Therefore, the processes of transportation, internal logistics, production and assembly can be simplified. It should be mentioned that each short side plate 128 has a holding hole 130 formed thereon, so that the user can readily take out the cushion 108 and the first article 102 from the outer box 106.

Figure 2:
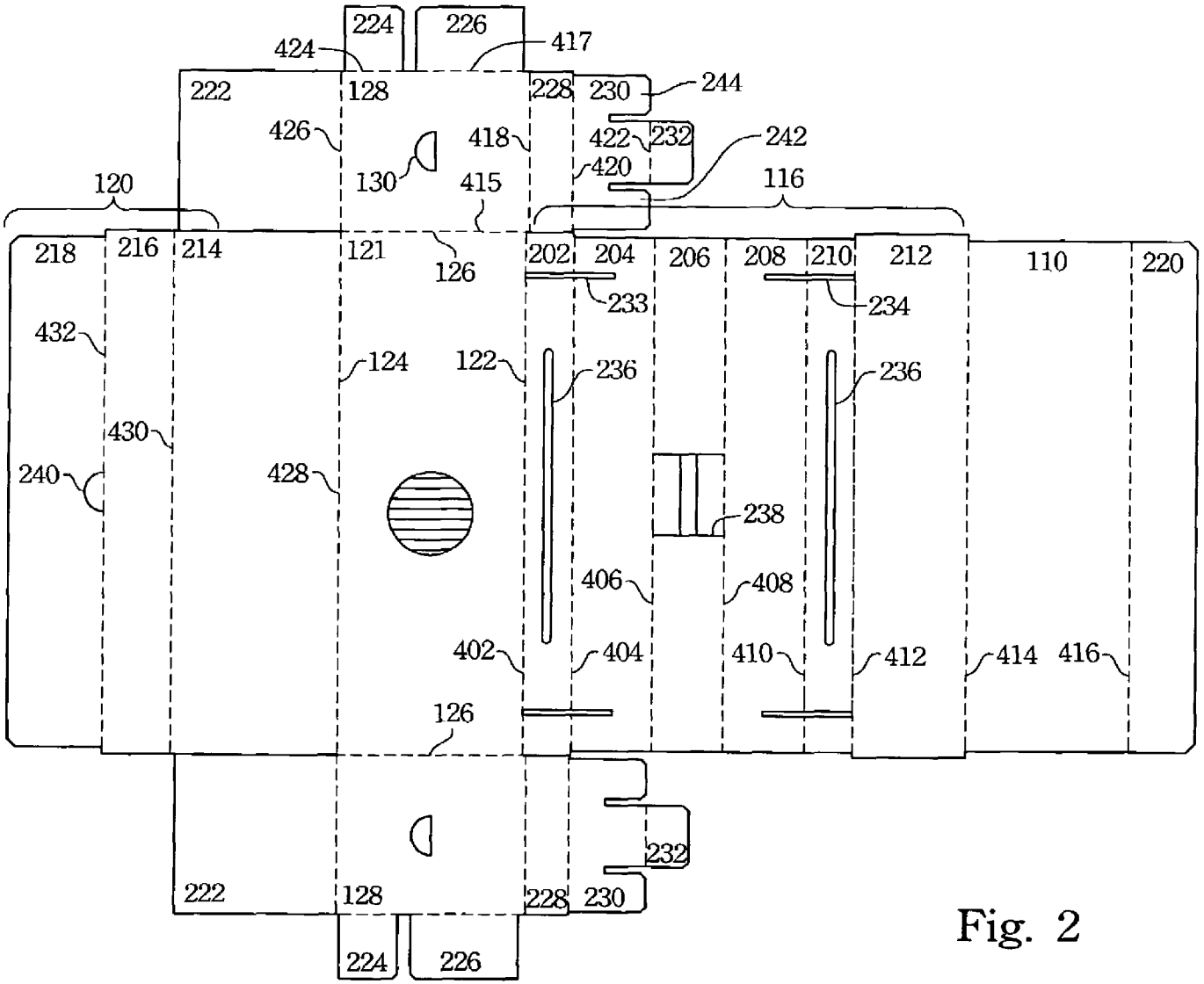
FIG. 2 is a schematic view of the plate material of the cushion in the preferred embodiment.

With reference to FIG. 2, the plate material 200 is preferably made of paper, such as corrugated paper and copperplate paper. The wave direction of the material (e.g., corrugated paper) has the design to sustain longitudinal pressure (axial pressure). This enhances the structural strength of the package boxes when they are stacked together. The plate material 200 can be formed by thermal molding on paper pulp or by cutting a single paper board. Before folding, the plate material 200 is a flat paper board with several folding lines. The cushion is formed after folding.

More explicitly, the plate material 200 includes a bottom plate 121, short side plates 128, a concave structure 116, and a box structure 120. The concave structure 116 includes a first concave plate 202, a second concave plate 204, a third concave plate 206, a fourth concave plate 208, a fifth concave plate 210, and a top plate 212 connected in sequence. The box structure 120 includes a first box plate 214, a second box plate 216, and a third box plate 218 connected in sequence. The bottom plate 121 is rectangular, having a first long side 122, a second long side 124, and two short sides 126. The short side plates 128 correspond to the short sides 126 and are connected with the bottom plate 121. The first concave plate 202 and the bottom plate 121 are connected by the first long side 122. The first box plate 214 and the bottom plate 121 are connected by the second long side 124.

The plate material 200 also includes a partition plate 110 and a partition sub-plate 220. One side of the top plate 212 is connected in sequence the partition plate 110 and the partition sub-plate 220. The other side of the top plate 212 is connected with the fifth concave plate 210. Besides, each short side plate 128 has a first structure plate 222, a second structure plate 224, and a third structure plate 226. Each short side plate 128 is also connected in sequence a first concave fixing plate 228, a second concave fixing plate 230, and a third concave fixing plate 232. The first structure plate 222 is connected to the side of the short side plate 128 near to the box structure 120. The first structure plate 222 and the first box plate 214 are not connected. The second structure plate 224 and the third structure plate 226 are connected to the side of the short side plate 128 away from the bottom plate 121. The side of the short side plate 128 near to the concave structure 116 is connected in sequence the first concave fixing plate 228, the second concave fixing plate 230, and the third concave fixing plate 232. The first concave fixing plate 228 and the first concave plate 202 are not connected.

The plate material 200 further includes a first gap 233 and a second gap 234. The first gap 233 is formed on both ends of the first concave plate 202 and the second concave plate 204. The second gap 234 is formed on both ends of the fourth concave plate 208 and the fifth concave plate 210. In order for the cushion 108 to provide better cushion effects, the first concave plate 202 and the fifth concave plate 210 have a cushion opening 236 thereon, respectively. The third concave plate 206 has an H-shaped cut 238 thereon. The cushion opening 236 is parallel to the first long side 122 and can be a long stripe of opening. Its length is about ⅔ of the length of the bottom plate 121.

Figure 3:
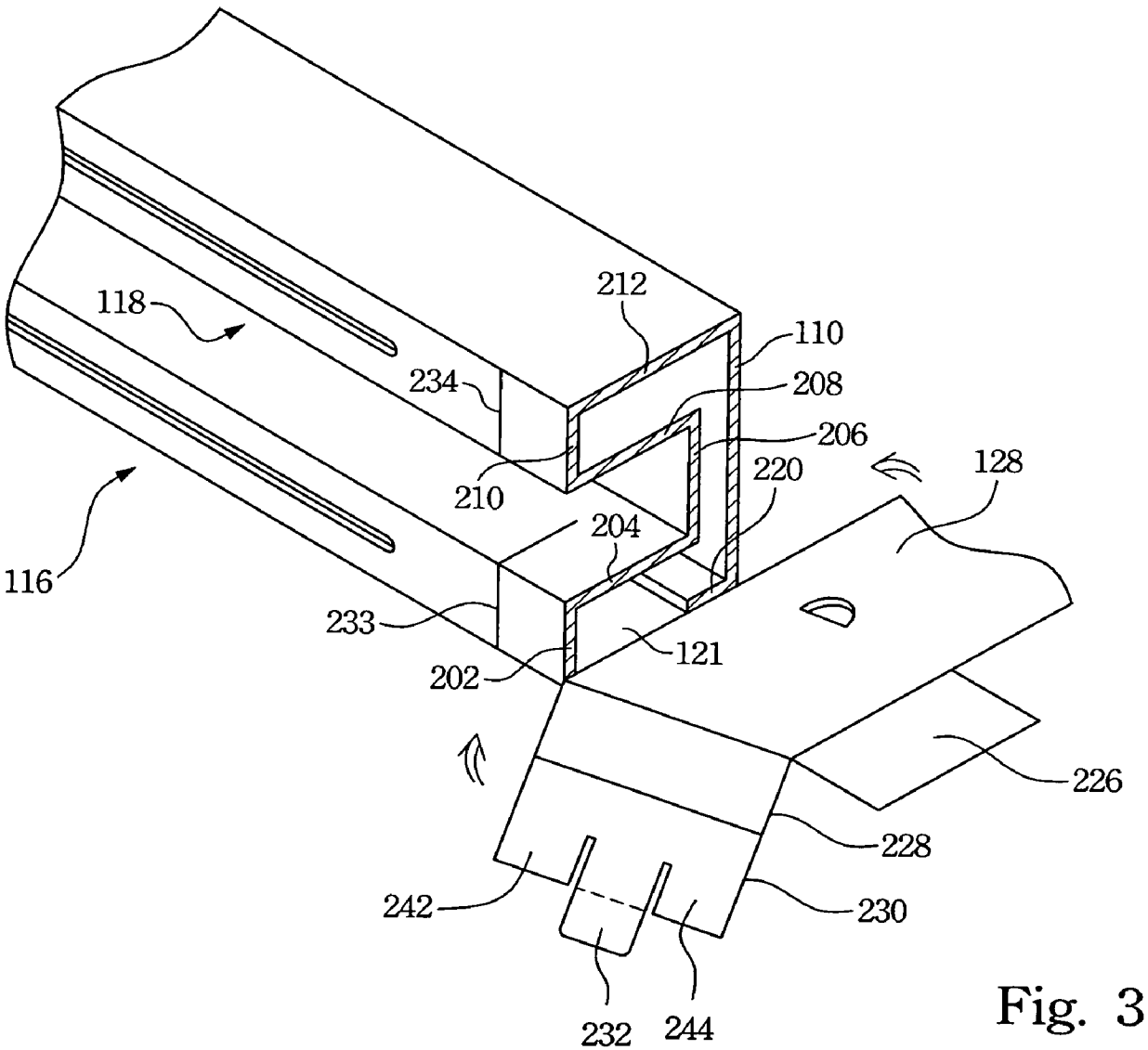
FIG. 3 is a schematic view of the concave structure of the plate material in FIG. 2 after some folding.

In the following, the folding steps are explained with reference to the accompanying drawings. FIG. 3 is a schematic view showing that part of the concave structure 116 of the plate material 200 in FIG. 2 is folded. With simultaneous reference to FIGS. 2 and 3, one folds in sequence along the folding line 402, the folding line 404, the folding line 406, the folding line 408, the folding line 410, and the folding line 412, so that the bottom plate 121, the first concave plate 202, the second concave plate 204, the third concave plate 206, the fourth concave plate 208, the fifth concave plate 210, and the top plate 212 are connected perpendicularly in sequence to form the container space 118. Afterwards, one folds along the folding lines 414, 416 so that the partition plate 110 is connected perpendicularly with the bottom plate 121. At the same time, the partition sub-plate 220 and the bottom plate 121 are in touch in order to fix the position of the partition plate 110.

Figure 4:
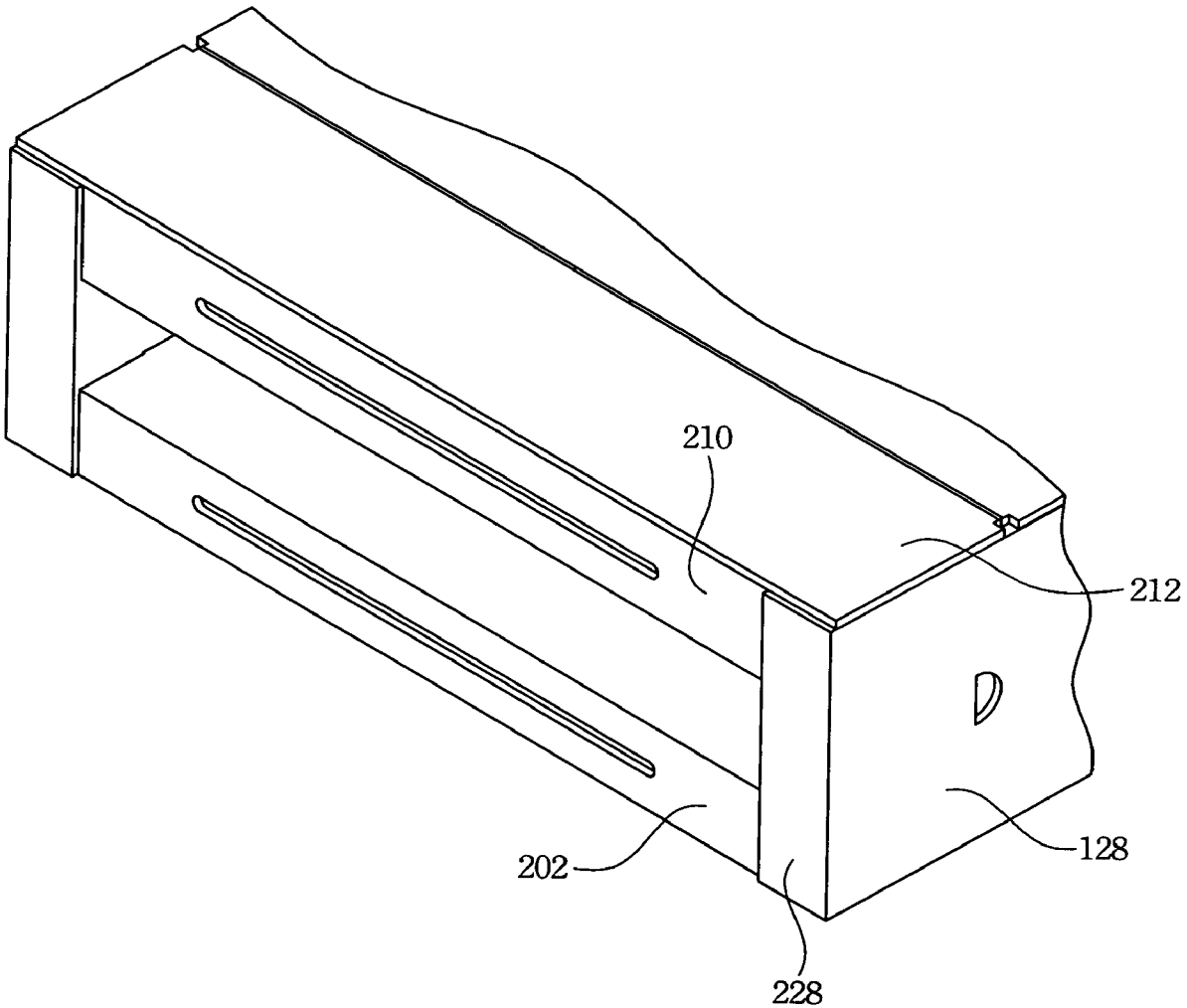
FIG. 4 is a schematic view of the concave structure in FIG. 2 after all the folding.

Afterwards, both ends of the cushion 108 are folded as follows to fix the concave structure 116. First, one fold along the folding lines 415, 417, and inserts the third structure plate 226 into the space enclosed by the fifth concave plate 210, the top plate 212, and the partition plate 110, so that the short side plates 128 and the bottom plate 121 are perpendicular to each other. Afterwards, one folds along the folding lines 418, 420, 422, and inserts the third concave fixing plate 232 between the first concave plate 202 and the fifth concave plate 210. Moreover, one inserts a first inserting chip 242 and a second inserting chip 244 of the second concave fixing plate 230 into the first gap 233 and the second gap 234 respectively, so that the first concave fixing plate 228 is disposed on the first concave plate 202 and the fifth concave plate 210, thereby fixing the concave structure 116. In the end, one obtains the structure in FIG. 4.

Figure 5:
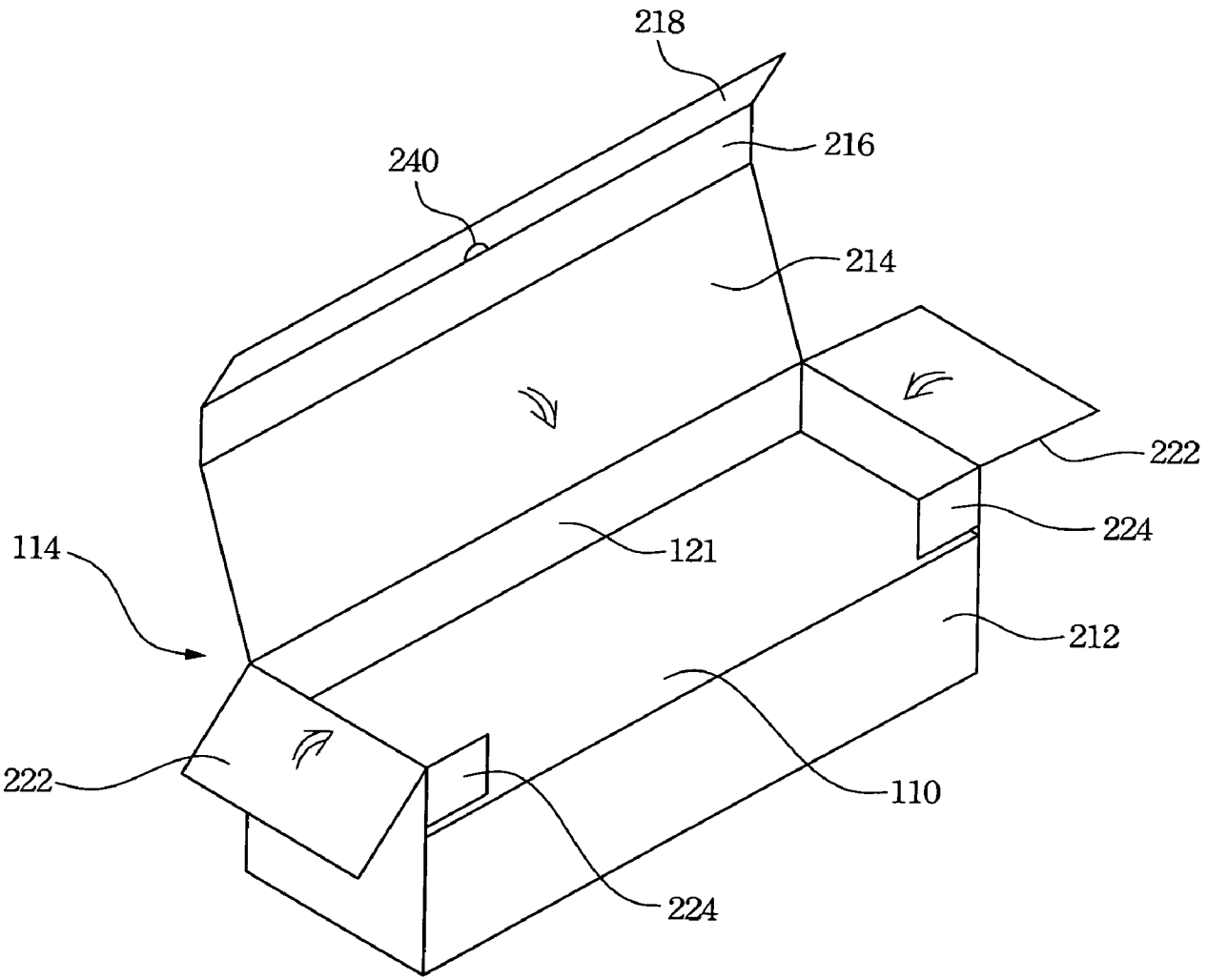
FIG. 5 is a schematic view of the box structure of the plate material in FIG. 2 after some folding.

FIG. 5 shows the box structure 120 of the plate material 200 in FIG. 2 after some folding. Please refer simultaneously to FIGS. 2 and 5. First, one folds along the folding lines 424, 426, so that the first structure plate 222 and the second structure plate 224 are disposed inside the second rectangular sub-body 114 and both the first structure plate 222 and the second structure plate 224 are perpendicular to the short side plates 128. Afterwards, one folds along the folding lines 428, 430, 432, so that the bottom plate 121, the first box plate 214, the second box plate 216, and the third box plate 218 are connected perpendicularly in sequence. Then, the third box plate 218 is inserted between the top plate 212 and the first structure plate 222. Thus, the cushion has a smooth shape. It should be mentioned that the third box plate 218 can have an opening 240 thereon for the user to open conveniently. The opening 240 is formed at the interface between the third box plate 218 and the second box plate 216.

Figure 6:
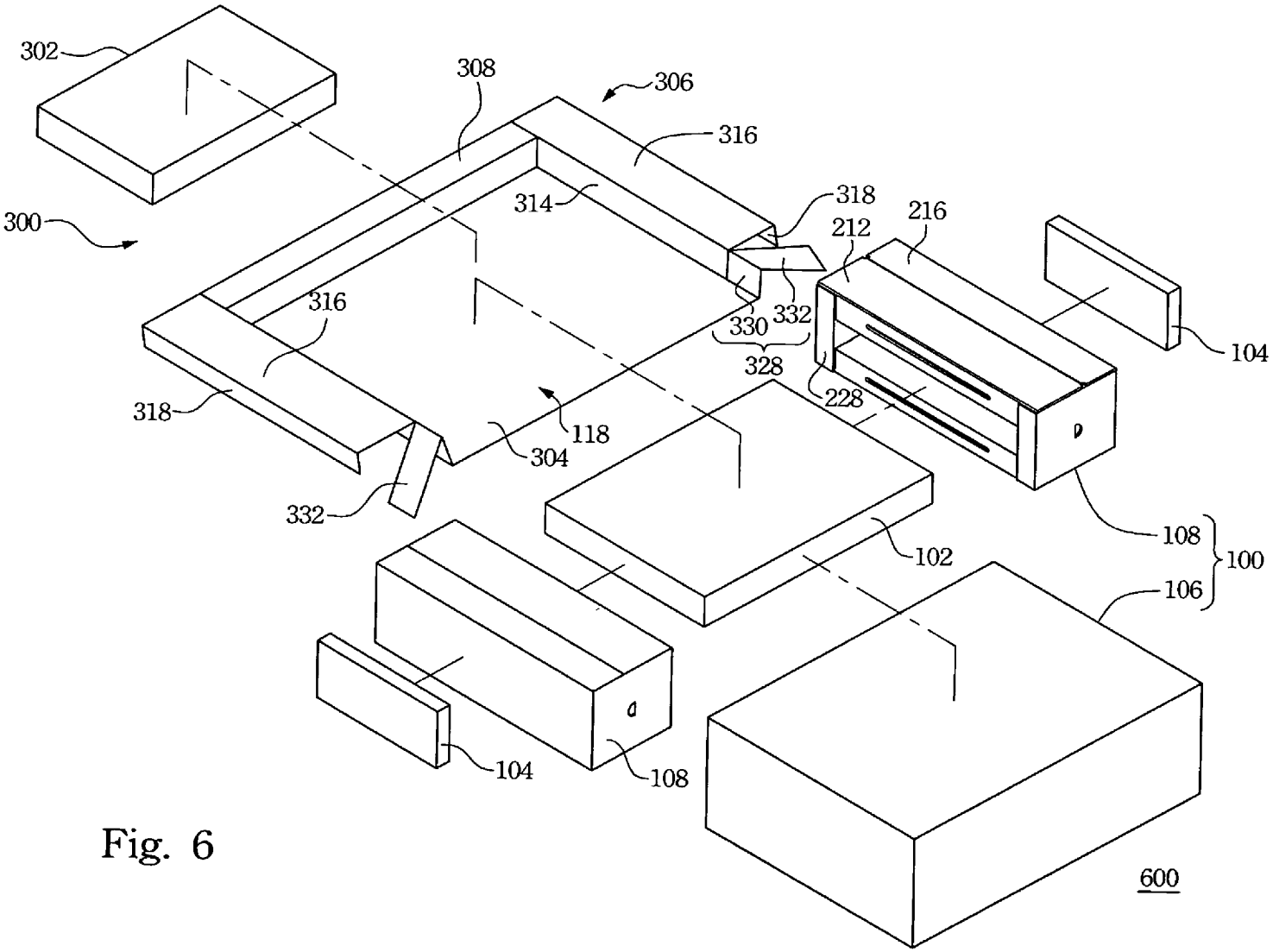
FIG. 6 is a schematic view of the package box in another embodiment of the invention.
Figure 7:
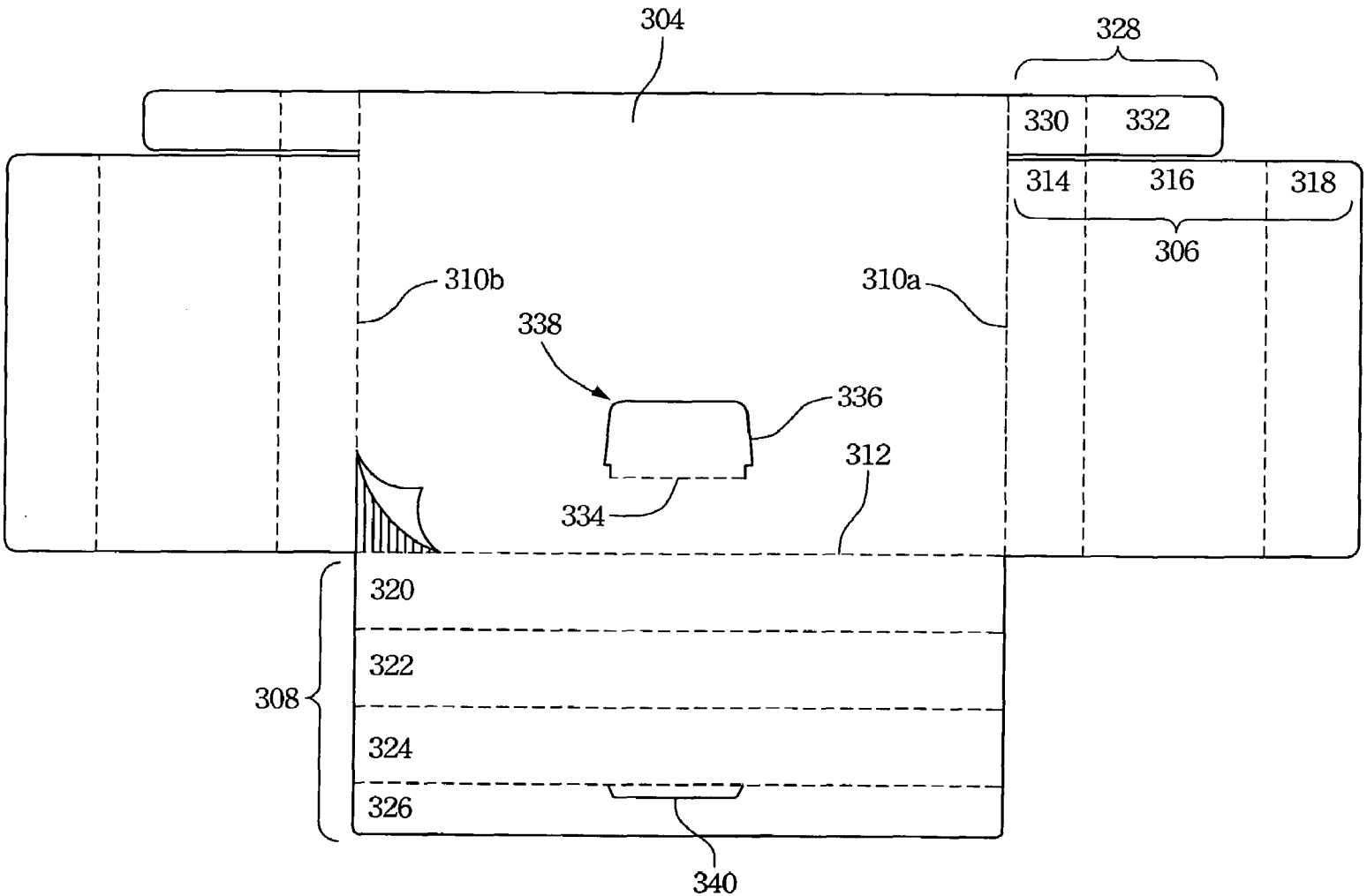
FIG. 7 is an expanded view of the accessory partition plate of FIG. 6.

FIG. 6 is a schematic view of the package box 100 in another embodiment of the invention. The package box 100 includes an outer box 106, two cushions 108, and an accessory partition plate 300. The accessory partition plate 300 is disposed over the cushions 108 for the deposition of a third article 302 (e.g., the manual), so that the third article 302 is kept neatly inside the package box 100. FIG. 7 is an expanded view of the accessory partition plate 300 in FIG. 6. With simultaneous reference to FIGS. 6 and 7, the accessory partition plate 300 includes a substrate 304, two side structures 306, and a bottom structure 308. The side structures 306 are connected respectively to the two opposite sides 310*a*, 310*b* of the substrate 304. The bottom structure 308 is connected to the bottom side 312 of the substrate 304 to form an open container space 118. The side structure 306 includes a first side plate 314, a second side plate 316, and a third side plate 318 connected in sequence. The bottom structure 308 includes a first bottom plate 320, a second bottom plate 322, a third bottom plate 324, and a fourth bottom plate 326 connected in sequence. It should be mentioned that the width of the substrate 304 is equal to the distance between the two cushions 108. The width of the second side plate 316 is equal to that of the top plate 212 of the cushion 108, so that the third side plate 318 can be inserted into the gap between the top plate 212 and the second box plate 216. Moreover, the substrate 304 also has a pair of fixing parts 328, each of which has a first fixing chip 330 and a second fixing chip 332. The first fixing chip 330 is close to the first concave fixing plate 228. The second fixing plate 332 can be inserted into the gap between the first concave fixing plate 228 and the top plate 212 for fixing the accessory partition plate 300 on the cushion 108. Besides, the substrate 304 has a chip folding line 334 and a chip cutting line 336 for forming an inserting chip 338. The fourth bottom plate 312 has a slit 340. The inserting chip 338 can be inserted into the slit 340 for fixing the bottom structure 308 as a rectangular body. It should be mentioned that the accessory partition plate 300 needs to be rotated horizontally by 180 degrees during the assembly. The drawing is made in such a way to conveniently explain the second fixing chip 332.

In summary, the invention has the following advantages:

1. The cushion can support and fix the articles inside the package box, preventing them from damages due to external impacts.

2. The cushion can be folded from paper materials that are environmentally friendly.

3. The cushion has a smooth shape to avoid cutting the user.

4. The cushion can accommodate accessories with reduced number and types of packaging elements. In addition to minimizing packaging materials, the quantity that can be held in one transportation can be increased to reduce the transportation cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cushion for a package box, comprising:

a rectangular bottom plate having a first long side, a second long side, and two short sides;

two short side plates corresponding to the short sides and connected perpendicularly with the bottom plate, forming a rectangular body;

a partition plate disposed between the short side plates and perpendicular to the bottom plate and the short side plates, dividing the cushion into a first rectangular sub-body and a second rectangular sub-body;

a concave structure on the first rectangular sub-body for forming a container space caved in the first rectangular sub-body to contain a first article therein, the concave structure including a first concave plate, a second concave plate, a third concave plate, a fourth concave plate, a fifth concave plate, and a top plate connected perpendicularly in sequence, with the first concave plate and the bottom plate being connected perpendicularly on the first long side; and a box structure disposed on the second rectangular sub-body and being capable of being selectively opened or closed to contain a second article in the second rectangular sub-body.

2. The cushion for a package box of claim 1, wherein the concave structure has a first gap and a second gap, the first gap being on the first concave plate and the second concave plate, and the second gap being on the fourth concave plate and the fifth concave plate.

3. The cushion for a package box of claim 2, wherein each of the short side plates includes a first concave fixing plate, a second concave fixing plate, and a third concave fixing plate connected in sequence, with the first concave fixing plate disposed on the first concave plate and the fifth concave plate, the second concave fixing plate and the third concave fixing plate being inserted into the first gap and the second gap.

4. The cushion for a package box of claim 1, wherein the first concave plate and the fifth concave fixing plate have respectively a cushion opening parallel to the first long side.

5. The cushion for a package box of claim 1, wherein the third concave plate has an H-shaped cut formed thereon.

6. The cushion for a package box of claim 1, wherein the material of the cushion is paper.

7. The cushion for a package box of claim 1, wherein each of the short side plates has a holding hole formed thereon.

8. The cushion for a package box of claim 1, wherein the box structure includes a first box plate, a second box pate, and a third box plate connected perpendicularly in sequence, with the first box plate and the bottom plate connected perpendicularly on the second long side.

9. The cushion for a package box of claim 8, wherein the third box plate has an opening formed thereon.

10. A plate material for forming a cushion of a package box, comprising:

a rectangular bottom plate having a first long side, a second long side, and two short sides;

two short side plates corresponding to the short sides and connected to the bottom plate;

a concave structure, including a first concave plate, a second concave plate, a third concave plate, a fourth concave plate, a fifth concave plate, and a top plate connected in sequence, with the first concave plate and the bottom plate connected with the first long side, the third concave plate having an H-shaped cut formed thereon;

a box structure, including a first box plate, a second box plate, and a third box plate connected in sequence, with the first box plate and the bottom plate connected on the second long side; and a partition plate connected with the top plate.

11. The plate material of claim 10 further comprising a first gap formed on the first concave plate and the second concave plate; and a second gap formed on the fourth concave plate and the fifth concave plate.

12. The plate material of claim 10, wherein each of the short side plates includes a first concave fixing plate, a second concave fixing plate, and a third concave fixing plate connected in sequence, with the first concave fixing plate connected with the short side plate.

13. The plate material of claim 10, wherein the first concave plate and the fifth concave plate have a cushion opening formed parallel to the first long side, respectively.

14. The plate material of claim 10, wherein the material of the cushion is paper.

15. The plate material of claim 10, wherein each of the short side plates has a holding hole thereon.

16. The plate material of claim 10, wherein the third box plate has an opening thereon.

17. A package box, comprising:

an outer box; and at least two cushions disposed symmetrically inside the outer box, at least one of which includes:

a rectangular bottom plate having a first long side, a second long side, and two short sides;

two short side plates corresponding to the short sides and connected perpendicularly with the bottom plate, forming a rectangular body;

a partition plate disposed between the short side plates and perpendicular to the bottom plate and the short side plates, dividing the cushion into a first rectangular sub-body and a second rectangular sub-body;

a concave structure on the first rectangular sub-body for forming a container space caved in the first rectangular sub-body to contain a first article therein;

a box structure disposed on the second rectangular sub-body and being capable of selectively opened or closed to contain a second article in the second rectangular sub-body; and an accessory partition plate disposed on the cushions, wherein the accessory partition plate includes:

a substrate having a bottom side and two opposite sides adjacent to the bottom side;

two side structures connected with the two opposite sides of the substrate; and a bottom side structure connected with the bottom side of the substrate;

wherein the substrate, the side structures, and the bottom side structure enclose a container space for containing a third article.

* * * * *